US009279175B2

(12) United States Patent
Blumenau et al.

(10) Patent No.: US 9,279,175 B2
(45) Date of Patent: Mar. 8, 2016

(54) METHOD FOR HOT DIP COATING A FLAT STEEL PRODUCT

(75) Inventors: Marc Blumenau, Hagen (DE); Hans-Joachim Heiler, Moers (DE); Fred Jindra, Lennestadt (DE); Rudolf Schoenenberg, Daphne, AL (US); Hans-Joachim Krautschick, Solingen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 328 days.

(21) Appl. No.: 13/819,481

(22) PCT Filed: Aug. 18, 2011

(86) PCT No.: PCT/EP2011/064222

§ 371 (c)(1),
(2), (4) Date: Apr. 22, 2013

(87) PCT Pub. No.: WO2012/028465

PCT Pub. Date: Mar. 8, 2012

(65) Prior Publication Data

US 2014/0144550 A1 May 29, 2014

(30) Foreign Application Priority Data

Aug. 31, 2010 (DE) ..... 10 2010 037 254

(51) Int. Cl.

| | |
|---|---|
| ***C23C 2/02*** | (2006.01) |
| ***C23C 8/10*** | (2006.01) |
| ***C23C 2/12*** | (2006.01) |
| ***C23C 2/40*** | (2006.01) |
| *C23C 2/00* | (2006.01) |

(52) U.S. Cl.
CPC ... *C23C 2/02* (2013.01); *C23C 2/12* (2013.01); *C23C 2/40* (2013.01)

(58) Field of Classification Search
CPC ..... C23C 2/02; C23C 2/12; C23C 2/40; C23C 8/10
See application file for complete search history.

(56) References Cited

U.S. PATENT DOCUMENTS

| | | | |
|---|---|---|---|
| 4,675,214 | A | 6/1987 | Kilbane et al. |
| 4,883,723 | A | 11/1989 | Kilbane et al. |
| 5,023,113 | A | 6/1991 | Boston et al. |
| 5,066,549 | A | 11/1991 | Kilbane et al. |
| 5,116,645 | A | 5/1992 | Boston et al. |

(Continued)

FOREIGN PATENT DOCUMENTS

| | | | |
|---|---|---|---|
| AT | 392089 | B | 1/1991 |
| CN | 1040828 | A | 3/1990 |

(Continued)

*Primary Examiner* — Lois Zheng
(74) *Attorney, Agent, or Firm* — The Webb Law Firm

(57) ABSTRACT

A method for hot dip coating a flat stainless steel product with more than 5 wt. % Cr with a protective metallic coating by: heating the flat steel product under an oxygen-free heating atmosphere to 100° C.-600° C. within 1-30 seconds; continuing heating to a holding temperature of 750° C.-950° C., by heating to 550° C.-800° C. under an inert or reducing atmosphere, holding within this temperature window for 1 to 15 seconds under an oxidizing atmosphere, and continuing heating under an inert or reducing atmosphere, until the holding temperature is reached; holding at the holding temperature for 10-120 seconds under a reducing atmosphere; and passing the flat steel product through a nozzle area under an inert or reducing atmosphere at 430°-780° C. and into a molten bath in which the flat steel product is coated with the metallic coating.

11 Claims, 1 Drawing Sheet

(56) References Cited

U.S. PATENT DOCUMENTS

| | | | | |
|---|---|---|---|---|
| 5,358,744 | A | 10/1994 | Buscarlet et al. | |
| 5,591,531 | A | 1/1997 | Jasper | |
| 2003/0047255 | A1 * | 3/2003 | Delaunay | C23C 2/02 148/579 |
| 2008/0023111 | A1 * | 1/2008 | Nakanishi et al. | 148/284 |
| 2008/0142125 | A1 | 6/2008 | Meurer et al. | |
| 2008/0308191 | A1 | 12/2008 | Leuschner et al. | |
| 2009/0188591 | A1 | 7/2009 | Eichelkrauth et al. | |
| 2009/0199931 | A1 | 8/2009 | Leuschner et al. | |
| 2010/0024925 | A1 | 2/2010 | Warnecke et al. | |
| 2011/0017362 | A1 | 1/2011 | Warnecke et al. | |

FOREIGN PATENT DOCUMENTS

| | | | | |
|---|---|---|---|---|
| DE | 69104789 | T2 | 3/1995 | |
| DE | 102006005063 | A1 | 8/2007 | |
| EP | 0246418 | A2 | 11/1987 | |
| EP | 0467749 | B1 | 10/1994 | |
| EP | 1693477 | A1 | 8/2006 | |
| EP | 1829983 | A1 | 9/2007 | |
| EP | 1857566 | A1 | 11/2007 | |
| EP | 2010690 | | 1/2009 | |
| EP | 2055799 | A1 | 5/2009 | |
| EP | 2184376 | A1 | 5/2010 | |
| GB | 1496398 | A | 12/1977 | |
| JP | 3111546 | A | 5/1991 | |
| JP | 5311380 | A | 11/1993 | |
| JP | 07-216524 | * | 5/1995 | C23C 2/02 |
| JP | 07-252624 | * | 10/1995 | C23C 2/06 |
| WO | 2006061151 | A1 | 6/2006 | |
| WO | 2007124781 | A1 | 11/2007 | |

* cited by examiner

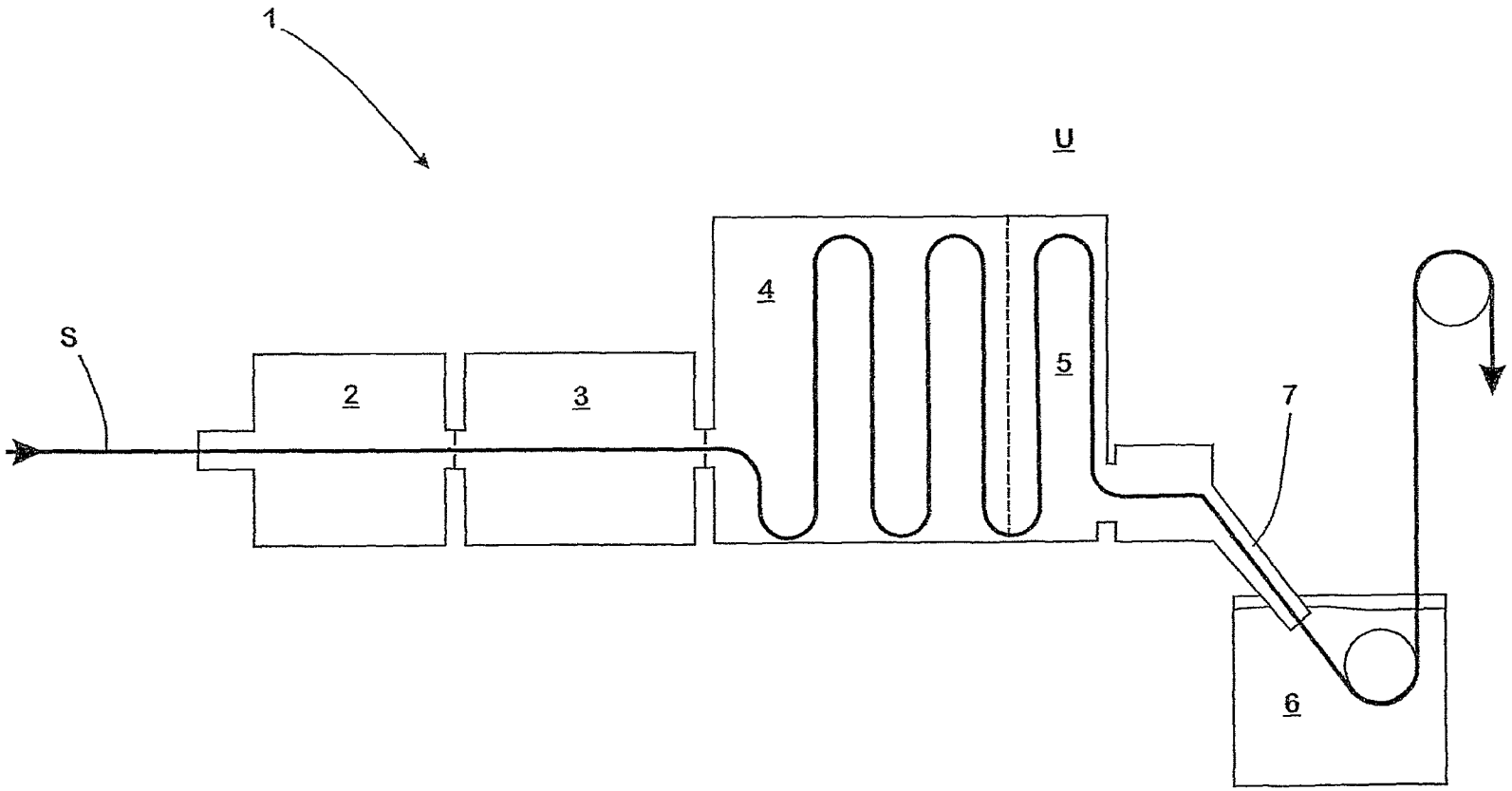
1
2
3
4
5
6
7
U
S

METHOD FOR HOT DIP COATING A FLAT STEEL PRODUCT

BACKGROUND OF THE INVENTION

1. Field of the Invention

The invention relates to a method for hot dip coating a flat steel product manufactured from a stainless steel which contains more than 5 wt. %, in particular at least 10.5 wt. %, Cr with a protective metallic coating to protect it against corrosion. "Flat steel products" here means steel strips or steel sheets.

2. Description of Related Art

Steels of the type in question with a high chromium content above 5 wt. % and typically up to 30 wt. % characteristically have a particularly good chemical resistance and high corrosion resistance. These product properties are based on the formation of a stable chromium oxide layer which passivates the steel surface effectively against external influences even at high temperatures. This means that steel goods with a chromium proportion of >10.5 wt. % are also termed rust, heat and acid resistant, or stainless steels for short. Further alloy elements such as nickel or molybdenum can help this passivation.

Despite these excellent specific material properties in relation to environmental influences, the use of chromium-alloyed steels for particularly stressed components can make it technically necessary and/or economically sensible to apply an additional protective coat.

The chemical passivity of the covering layer of chromium oxide is a problem here. This layer hinders both the wetting and the adhesion reaction when coating with a metallic coating.

Coating steels with at least 5 wt. % Cr thus presents a particular challenge.

It is known from AT 392089 B that stainless steels can be galvanised on one side and on both sides electrolytically in a continuous strip process. However, this method is comparatively expensive and has therefore not been implemented in practice.

A cost-efficient alternative to electrolytic coating is the continuous hot dip coating of steel strips. In this method, after recrystallising annealing has been carried out on a steel strip in a continuous furnace, it is submerged for a short period into a metallic molten bath which is typically based on zinc, aluminium or alloys thereof.

The hot dip coating of alloyed steels requires particular care, since with these steels, during the annealing phase alloy components which have a particular affinity for oxygen can selectively oxidise on the surface of the steel. If the selective oxidisation takes place externally, i.e. with the oxygen from the atmosphere, problems with wetting and a lack of adhesion are to be expected.

For high strength/maximum strength multiphase steels which have a comparatively low, typically 0.3-2.0% Cr alloy proportion, a method described in EP 2 010 690 B1 is proven in which the respective flat steel product is heated in a first work step in a reducing atmosphere with an $H_2$ content of at least 2% by volume to 8% by volume to a temperature of >750° C. to 850° C. and in which the surface, which mainly consists of pure iron, is then transformed into an iron oxide layer by heat treatment of the flat steel product at a temperature of >750° C.-850° C. lasting 1 to 10 seconds in a reaction chamber integrated into a continuous furnace with an oxidising atmosphere with an $O_2$ content of 0.01% by volume to 1% by volume and in which the flat steel product is then annealed in a reducing atmosphere with an $H_2$ content of 2% by volume to 8% by volume by heating to a maximum of 900° C. over a time period which is so much longer than the duration of the heat treatment carried out to form the iron oxide layer that the previously formed iron oxide layer is reduced to pure iron at least on its surface. The flat steel product pre-treated in this way can be hot dip coated with the metallic coating in a warmed state in a molten bath which contains overall at least 85 wt. % zinc and/or aluminium.

A flat steel product hot dip coated with aluminium for exhaust systems is further known from EP 2 184 376 A1. However, this document does not suggest how the hot dip coating can be carried out in practice. The possibility of pre-coating with iron is suggested, which would make aluminium dip coating considerably easier but is more expensive.

In principle, two types of method are known for the hot dip coating of steels with more than 5 wt. % Cr, in particular more than 10 wt. % Cr which each assume that the steel strip to be coated can be prepared using an annealing treatment such that an optimal coating is achieved.

The first type of method provides for annealing under drastically reducing atmosphere.

A variant of this type of method is described in U.S. Pat. No. 4,675,214 (EP 0 246 418 B1), U.S. Pat. No. 5,066,549 and U.S. Pat. No. 4,883,723. This variant assumes that the flat steel product to be coated is heated in a non-oxidative atmosphere and then held at more than 677° C. in a drastically reducing atmosphere with over 95% by volume $H_2/N_2$ for steels with 6.0-14.5 wt. % Cr. The coating is then carried out in an aluminium or aluminium/silicon molten bath.

An additional variant of the first type of method is known from U.S. Pat. No. 5,023,113. This variant is based on flat steel products with a chromium content >10 wt. %. These flat steel products are heated to 650° C. with no free oxygen and then held at 845-955° C. under an atmosphere which contains >95% by volume $H_2/N_2$. In addition to this, in the nozzle through which the steel strip is carried from the furnace to the molten bath, should have atmosphere >97% by volume $H_2/N_2$ with a dew point of <−29° C.

A third variant of the first type of method is known from U.S. Pat. No. 5,591,531. According to this variant, steel strips with up to 30 wt. % Cr are subject to batch annealing which creates a surface layer that is rich in iron. The actual annealing then takes place in accordance with one of the two above mentioned variants of the first type of method.

The method known from EP 0 467 749 B1 (DE 691 04 789 T2) avoids these annealing conditions by preheating to temperatures of less than 500° C. under a non-oxidising atmosphere which may therefore contain <3% by volume $O_2$. It is then further heated to a holding temperature of less than 950° C. in a non-oxidising, non-reactive N2 or H2/N2 atmosphere with a dew point below −40° C. An Al or AlSi melt is also used for the hot dip coating.

The second known type of method is based on the use of the oxidation/reduction technique ("pre-oxidation").

A first variant of this second type of method is described in JP 3111546 A. In accordance with this known method, a steel strip alloyed with 10.0%-25.0 wt. % Cr is oxidised in a directly fuelled pre-heater at temperatures of 400-600° C. The FeO layer created in this way is then reduced during a holding phase at 700-950° C. The steel strip which has been treated in this way is then subject to hot dip aluminising.

According to JP 5311380 A in accordance with a second variant of the second type of method a steel strip containing 10.0%-25.0 wt. % Cr is hot dip aluminised in a similar manner. In this way, the pre-oxidation also takes place during heating up directly to a temperature between 550-750° C. by regulating the X value to 0.9-1.5. The reduction of the FeO layer then takes place under a reducing atmosphere at a holding temperature which is around 800° C. or reaches up to a maximum of 1050° C.

The first type of method can only be carried out at high cost in everyday work using hot dip coating equipment designed for conventionally alloyed steel. The necessary high annealing temperatures and the high consumption of $H_2$ result in considerably increased operating costs. Commercial practice also shows that a dew point <−40° C. cannot be reliably maintained in the holding zone of the continuous furnace.

The variants belonging to the second type of method could be achieved considerably easier as part of a commercial hot dip coating process. However, here too operating practice shows that the problems with wetting in flat steel products made of steels with high Cr contents cannot be reliably avoided. Particularly the low pre-oxidation temperatures given in JP 3111546 A prove to be particularly critical in the operation conditions used in practice.

A further disadvantage of the type of method described above is that this method only relates to hot dip aluminising.

Against this background, the object of the invention was to provide a method which allows flat steel products provided for applications particularly subject to corrosion, containing more than 5.0 wt. % chromium, to be provided with hot dip coating in a manner which is cost-effective and environmentally friendly.

SUMMARY OF THE INVENTION

According to the invention, an alloyed flat steel product with high Cr content is initially heat-treated in a process of continuous successive work steps in a continuous furnace and immediately afterwards is inline surface galvanised. Depending on the desired use, according to the invention a zinc, zinc/aluminium, zinc/magnesium, aluminium or aluminium/silicon hot dip coating can be applied.

The method according to the invention for hot dip coating a flat steel product which is manufactured from a stainless steel which contains more than 5 wt. % Cr, in particular at least 10.5 wt. % Cr, with a protective metallic coating which protects against corrosion includes fort this purpose the following work steps carried out in sequential order:

a) within 1-30 s heating of the flat steel product to a heating temperature of 100-600° C. under a heating atmosphere which is oxygen-free with the exception of operation-related impurities preventing the oxidation of the surface of the flat steel product;

b) continuation of the heating of the flat steel product up to a holding temperature of 750-950° C., wherein
   - up to a pre-oxidation temperature window of 550-800° C. the heating is carried out under an inert or reducing heating atmosphere,
   - for 1-15 s within the pre-oxidation temperature window the heating is carried out under an oxidising pre-oxidation atmosphere in order to cause a pre-oxidation of the surface of the flat steel product, and
   - after leaving the pre-oxidation temperature window, the heating is then carried out under an inert or reducing atmosphere once again until the holding temperature is reached;

c) holding the pre-oxidised flat steel product at the holding temperature for 10-120 s under a reducing holding atmosphere;

d) optionally: ageing the flat steel product for 1-30 s under an inert or reducing ageing atmosphere at an ageing temperature of 430-780° C.

e) passing the flat steel product through a nozzle area and then through a molten bath in which the flat steel product is hot dip coated with the metallic coating, wherein the flat steel product is held in the nozzle area under an inert or reducing nozzle atmosphere until it enters the molten bath, and the temperature of the flat steel product as it passes through the nozzle area is 430-780° C.

DETAILED DESCRIPTION OF THE DRAWING

The FIGURE shows a schematic view of a coating in accordance with the invention of a steel strip S using a hot dip coating system 1.

DETAILED DESCRIPTION OF THE INVENTION

In accordance with the invention, particularly good wetting and good adhesion of the hot dip coating are achieved even at high levels of deformation by targeted temperature and atmosphere regulation in the continuous furnace in a reliable manner such that a two-step heating which is a combination of quick heating (first heating step—work step a)) and conventional additional heating (second heating step—work step b)) up to the holding temperature is carried out. This method enables a particularly homogeneous and therefore particularly effective pre-oxidation during the second heating step, which can be easily controlled. This produces a uniform FeO layer coat on the flat steel product to be coated, which layer acts as a diffusion barrier against Cr oxidation.

Optimal results are achieved if the temperature of the flat steel product at the end of the heating phase (work step a)) is in the range of 200-500° C.

The heating phase (work step a)) should preferably only last 1-5 sec.

In practice, quick heating (work step a)) in accordance with the invention can be carried out using a "booster heating system", as described in DE 10 2006 005 063 A1 for example. In this known booster system, the burner is operated with a fuel, in particular a fuel gas, and a gas containing oxygen. The flat steel product to be heated is brought into direct contact with a flame generated by the burner, wherein within the flame the air ratio λ is set depending on the starting temperature and/or the target temperature. In order to carry out the method according to the invention in this connection, the temperature, atmosphere and λ value of the booster flame are set such that non-reactive or reducing thermodynamic conditions are created for the metal/metal oxide balance of the alloy elements. Oxidation of the steel surface during the work step a) should be necessarily avoided.

In addition to $N_2$ and technically unavoidable impurities, the heating atmosphere during work step a) may optionally contain 1-50% by volume $H_2$.

Both the heating atmosphere and the pre-oxidation atmosphere can for example contain $H_2O$, CO or $CO_2$ as unavoidable impurities caused by manufacture.

While the heating atmosphere maintained in work step a) should be oxygen-free, in other words $O_2$ is only present in technically unavoidable, ineffective amounts, the pre-oxidation atmosphere may have 0.1%-3.0% by volume $O_2$ with a dew point of −20° C. to +25° C. in addition to $N_2$ and technically unavoidable impurities in order to achieve the desired oxidation result.

Pre-oxidation (work step b) typically lasts 1-15 seconds. It can, for example, be carried out in a directly heated DFF-type furnace (DFF=Direct Fired Furnace). In a DFF furnace, the oxidation potential on the gas burners used can be generated by setting the air ratio A in the atmosphere surrounding the strip. Heating in the DFF furnace also has the advantage that existing organic impurities on the surface of the flat steel product are removed by combustion. Alternatively, it is also conceivable to use a furnace of the RTF type (RTP=Radiant Tube Furnace), in which only jet tubes are used and the pre-oxidation of the iron takes places by adjusting the oxygen partial pressure in the pre-oxidation atmosphere.

Optimally, the flat steel product will be oxidised in an oxidation temperature range of 550-800° C., ideally at an oxidation temperature of 600-700° C., over a time period which is typically 1-15 s in order to avoid an external chromium oxide layer on the surface of the steel. To this end, in the furnace section, above which is the relevant oxidation temperature range, the predetermined $N_2/H_2$ annealing atmosphere can additionally be impinged with 0.1-3.0% by volume $O_2$, while in the furnace regions before and after this an atmosphere which is as oxygen-free as possible is maintained. This oxidising atmosphere can be set in a targeted manner in a DFF system such that an $\lambda$ value >1 is set in each section of the furnace. In an RTF system however, a furnace zone which is sealed off from the previous and subsequent continuous region can be formed, in which zone there is an oxygen-containing atmosphere. Alternatively, pre-oxidation can be carried out by means of an additional intermediary booster system.

In the course of pre-oxidation carried out in accordance with the invention, an iron oxide layer develops on the surface of the steel with a thickness of less than 300 nm, ideally in the range from 20-200 nm. The thickness of this optimally covering layer should be formed as homogeneously as possible over each surface of the flat steel product concerned in order to effect an effective diffusion barrier against external, selective Cr oxidisation. The dew point of the atmosphere maintained in the oxidation section of the furnace point may for this purpose lie between −20° C. and +25° C.

Optimal process times for simultaneously simple implementation of the methods are achieved when the successively completed work steps of the method according to the invention are carried out in a heat treatment line in which a booster device, a DFF furnace and/or an RTF furnace are combined with one another and in which a holding and cooling zone is connected to the part of the furnace which passes into the nozzle area which leads into the respective molten bath.

During the course of work step b), the flat steep product is further warmed starting from the heating temperature achieved after the work step a) of between 100° C. and 600° C. to the desired holding temperature of 750° C.-950° C. If the processed flat steel product is subject to recrystallising annealing before work step a) in order to soften it, the holding temperature may be limited to 750° C.-850° C. However, if the flat steel product enters the work step a) in an as-rolled state then it has been shown to be expedient to set the holding temperature at 800° C.-850° C. in order to effect a recrystallisation during the holding phase.

When the holding temperature is reached, the flat steel product which has been heated twice in a manner according to the invention and pre-oxidised in this connection is held for a sufficient period of time at the relevant holding temperature (work step c)). In addition to the recrystallisation of the structure carried out if necessary, during the holding phase (work step c)) the previously created FeO layer is reduced to metallic iron under a correspondingly set holding atmosphere. The new formation of external Cr oxides can effectively be avoided by forcing the internal Cr oxidation. This can be achieved by holding the dew point of the holding atmosphere at −30° C. to +25° C., in particular at more than −25° C. A dew point of this type ensures an $H_2O/H_2$ ratio which is high enough for a sufficient amount of oxygen to be available. Optimal results for holding at the holding temperature are accordingly achieved if the holding atmosphere during holding contains 1.0%-50.0% by volume $H_2$ in addition to $N_2$ and technically unavoidable impurities and has a dew point of −30° C. to +25° C. As mentioned, by having the dew point of the holding atmosphere be at least −30° C., in particular in the range from −25° C. to 0° C., the Cr oxidation occurring from the outside is additionally inhibited. The duration of the holding phase is, in practice, typically 10-120 s, wherein the systems available today optimally have displayed a holding duration of 30-60 s.

At the end of the holding (work step c)) and the optionally carried out ageing treatment (work step d)), the flat steel product is cooled to the relevant molten bath temperature and guided by means of a known nozzle construction into the respective molten bath (work step e)). It has been shown to be particularly advantageous for wetting if the nozzle atmosphere has a dew point of −80° C. to −25° C., in particular less than −40° C. A lower dew point of this type can be achieved by the additional feeding in of $N_2$ or $H_2$ directly into the nozzle area.

The molten bath filled in a known manner in a suitable molten bath boiler is then passed continuously by the flat steel product prepared in accordance with the invention, wherein in practice a submersion time of 0.5-10 s, in particular 1-3 s has been shown to be effective. In the molten bath boiler, the molten bath wets the steel surface resulting in a chemical reaction between the metallic iron of the steel strip and the molten bath to form an intermetallic boundary layer which ensures good adhesion of the coating. The strip submersion and molten bath temperatures result depending on the composition of the molten bath. Table 1 shows typical temperature ranges for coatings based on Zn (e.g. Zn, ZnAl, ZnMg or ZnMgAl coatings) and those based on Al (e.g. AlZn, AlSi coatings) at which the flat steel product is submerged into the respective molten bath, along with the matching temperature range of each molten bath.

TABLE 1

| Molten bath | Strip submersion temperature | Molten bath temperature |
|---|---|---|
| Zn base | 430-650° C. | 420-600° C. |
| Al base | 650-800° C. | 650-780° C. |

If the hot dip coating is carried out as hot dip aluminising and an ageing of the flat steel product is carried out then the ageing temperature can be set at 650° C.-780° C. in order to achieve further optimised adhesion of the coating.

After the product has left the molten bath the coating thickness is adjusted if necessary by means of hosing nozzles and the hot dip coated, Cr alloyed flat steel product produced is cooled. Additional post forming (temper rolling), passivising, oiling or winding of the flat steel product into a coil can be carried out optionally in addition to the cooling.

Depending on the coating applied in each case, the coated flat steel product according to the invention is suitable for a one-stage, two-stage or multi-stage cold or hot moulding to form a component. The advantages over conventional flat steel products and non-hot dip coated Cr alloyed flat steel products are in particular the considerably improved corrosion resistance of components which are used in areas of high corrosion potential. This has proven to be advantageous in particular if there are high temperatures at the place of use in question.

A particular versatility of the usability of flat steel products coated in accordance with the invention is that organic coatings or adhesives which are optimised for galvanised surfaces can now also be used effectively for components consisting of stainless Cr alloyed steels. This expands the spectrum of use for Cr alloyed steel products, for example for structural applications in the construction of automobile bodies or chemical apparatus and plant construction.

A stainless steel from which the flat steel product processed in accordance with the invention is made typically contains, in addition to iron and unavoidable impurities (in wt. %) Cr: 5.0-30.0%, Mn: less than 6.0%, Mo: less than 5.0%, Ni: up to 30.0%, Si: less than 2.0%, Cu: less than 2.0%, Ti: less than 1.0%, Nb: less than 1.0%, V: less than 0.5%, N: less than 0.2%, Al: less than 0.2%, C: less than 0.1%. By alloying of up to 30.0 wt. % Ni, an austenitic or ferrous-austenitic duplex structure can be created which increased the formability of the flat steel product still further. Corrosion resistance is also increased in this way and the formability of the flat steel product improved. Steel sheets or steel strips are particularly suitable for the method according to the invention, which sheets or strips are produced from a steel which is based on the alloy specification set out above, which has (in wt. %) Cr: 10.0-13.0%, Ni: less than 3.0%, Mn: less than 1.0%, Ti: less than 1.0%, C: less than 0.03%.

If flat steel products prepared in accordance with the invention are hot dip galvanised, molten baths are suitable for this which, in addition to zinc and unavoidable impurities which may include traces of Si and Pb, (in % by weight) 0.1-60.0% Al and up to 0.5% Fe. A galvanising bath may also be used in the manner of the prior art which is documented in EP 1 857 566 A1, EP 2 055 799 A1 and EP 1 693 477 A1, the contents of which are included to this extent in the contents of this application. Accordingly, the molten bath may contain, in addition to zinc and unavoidable impurities, (in % by weight) 0.1-8.0% Al, 0.2-8.0% Mg, <2.0% Si, <0.1% Pb, <0.2% Ti, <1% Ni, <1% Cu, <0.3% Co, <0.5% Mn, <0.1% Cr, <0.5% Sr, <3.0% Fe, <0.1% B, <0.1% Bi providing that for the ratio % Al/% Mg formed from the Al content % Al and the Mg content Mg % of the melt the following applies: % Al/% Mg<1. Regardless of the composition of the molten bath, hot dip galvanising achieves the optimal coating results if the molten bath temperature is 420° C.-600° C.

If flat steel products prepared in accordance with the invention are hot dip aluminised coated, molten baths are suitable therefor which comprise, in addition to aluminium and unavoidable impurities possibly including traces of Zn, (in % by weight) up to 15% Si and up to 5% Fe.

Optimal coating results are achieved if the molten bath temperature is 660° C.-680° C. The duration of submersion for hot dip aluminising is typically 0.5-10 s, in particular 1-3 s.

The invention is described below in greater detail by means of an exemplary embodiment.

The FIGURE shows a schematic view of a coating in accordance with the invention of a steel strip S using a hot dip coating system 1.

The hot dip coating system 1 comprises a booster zone 2 in which the steel strip S is quickly heated from room temperature to a temperature of 100° C.-600° C. In the booster device protected from the surroundings by a casing, the steel strip is quickly heated under an oxygen-free atmosphere, which in addition to nitrogen optionally contains up to 5% by volume $H_2$ and which has a dew point held at −20° C. to +25° C., to a strip temperature of 100° C.-950° C. within 1-30 s (work step a)).

At the end of the booster zone 2, the steel strip S extends without any interruptions and without coming into contact with the surrounding atmosphere U into a pre-oxidation zone 3. There, the steel strip is heated to a strip temperature of up to 950° C. under an atmosphere which is formed of nitrogen and up to 50% by volume $H_2$ and 0.1-3% by volume $O_2$ and which has a dew point held at −15° C. to +25° C. DFF burners are used as heating devices here, where the λ value here is set at >1 in order to oxidise the surface of the steel strip S in a targeted manner.

Finally, the steel strip S also passes through a holding zone 4 which is also protected from the environment, in which holding zone the steel strip S is held at the strip temperature previously achieved in the range from 750° C.-950° C. The atmosphere in the holding zone 4 consists of, in addition to nitrogen and unavoidable impurities, 1-50% by volume $H_2$ in order to achieve a reduction of the steel strip S in addition to the recrystallisation. The dew point of the holding zone atmosphere is held between −30° C. and +25° C.

A cooling zone 5 is connected to the holding zone 4, in which cooling zone the steel strip S is cooled under the unchanged holding zone atmosphere to the relevant entry temperature at which it can be placed in the molten bath 5.

The steel strip S is introduced into the molten bath 6 by means of a nozzle 7, which carries the steel strip S from the cooling zone 5 without any interruptions and further protects it from the surroundings U. In the nozzle 7 a nozzle atmosphere is maintained, which atmosphere either consists of nitrogen or of hydrogen or of a mixture of these two gases. The dew point of the nozzle atmosphere is held at −80° C. to −25° C.

Table 2 shows the composition of a steel used for the manufacture of the steel strip S (figures in % by weight, the remainder is iron and unavoidable impurities).

TABLE 2

| Cr | C | Si | Mn | Mo | Ni | Ti | Nb | Cu | Al |
|---|---|---|---|---|---|---|---|---|---|
| 11.52 | 0.015 | 0.55 | 0.39 | 0.01 | 0.12 | 0.212 | 0.01 | 0.03 | 0.02 |

Six samples of the steel strip S were passed through the hot dip coating system 1 for six tests V1-V6. The initial state of each of the samples processed, the method parameters set in each case TB a)=strip temperature at the end of the booster zone 2, TB b)=strip temperature at the end of the pre-oxidation zone 3, Atm b)=composition of the atmosphere in the pre-oxidation zone 3, TB c)=maximum strip temperature in the holding zone 4, Atm c)=composition of the atmosphere in the holding zone 4, TP c)=dew point of the atmosphere in the holding zone 4, TB e)=strip temperature in the nozzle zone 7, Atm e)=composition of the atmosphere in the nozzle zone 7, TP e)=dew point of the atmosphere in the nozzle zone 7, and the composition of each molten bath used are listed in table 3.

The assessments of the results of the coating for the six tests V1-V6 are summarised in table 4. It is shown that the samples coated in accordance with the invention have optimal coating results paired with an equally optimal behaviour of the coating when the respective sample is moulded into a component, whereas the samples processed not in accordance with the invention do not achieve this combination of characteristics.

TABLE 3

| Test | Initial State | TB a) [° C.] | TB b) [° C.] | Atm b) [Vol. %] | TB c) [° C.] | Atm c) [Vol. %] | TP c) [° C.] | TB e) [° C.] | Atm e) [Vol. %] | TP e) [° C.] | Composition of molten bath [% by weight] |
|---|---|---|---|---|---|---|---|---|---|---|---|
| T1 | Not annealed | 170 | 656 | 0.85% $O_2$, remainder $N_2$ | 818 | 5% $H_2$, remainder $N_2$ | −21 | 480 | $N_2$ | −51 | 0.9% Al 0.9% Mg remainder Zn |
| T2 | Annealed | 200 | 711 | 0.62% $O_2$, remainder $N_2$ | 810 | 7% $H_2$, remainder $N_2$ | −24 | 715 | $N_2$ | −50 | 10% Si remainder Al |
| T3 | Annealed | 200 | 657 | 1.16% $O_2$, remainder $N_2$ | 750 | 5% $H_2$, remainder $N_2$ | −10 | 678 | $N_2$ | −57 | 10% Si remainder Al |
| T4 | Annealed | 200 | 685 | 1.18% $O_2$, remainder $N_2$ | 765 | 5% $H_2$, remainder $N_2$ | −10 | 709 | $N_2$ | −57 | 10% Si remainder Al |
| T5 | Not annealed | *) | 660 | $N_2$ | 900 | 10% $H_2$, remainder $N_2$ | −29 | 680 | $N_2$ | −50 | 10% Si remainder Al |
| T6 | Annealed | *) | 730 | 0.10% $O_2$, remainder $N_2$ | 804 | 5% $H_2$, remainder $N_2$ | −24 | 462 | $N_2$ | −53 | 0.9% Al 0.9% Mg remainder Zn |

*) WORK STEP A) (RAPID HEATING IN THE BOOSTER ZONE 2) OMITTED

TABLE 4

| Test | Coating | | Mechanical set value | According to the invention |
|---|---|---|---|---|
| T1 | Good | Good | Reached | YES |
| T2 | Good | Good | Reached | YES |
| T3 | Good | Good | Reached | YES |
| T4 | Good | Good | Reached | YES |
| T5 | Destroyed | Destroyed | Not reached | NO |
| T6 | Destroyed | Destroyed | Not reached | NO |

The invention claimed is:

1. A method for hot dip coating of a flat steel product comprising a stainless steel comprising more than 5 wt. % Cr with a protective metallic coating which protects against corrosion, comprising the following work steps carried out in sequential order:

a) within 1-30 seconds, heating of the flat steel product to a heating temperature of 100-600° C. under a heating atmosphere which is oxygen-free with the exception of operation-related impurities preventing the oxidation of the surface of the flat steel product, the heating atmosphere comprising 1-50% by volume $H_2$ in addition to $N_2$ and technically unavoidable impurities;

b) continuation of the heating of the flat steel product up to a holding temperature of 750-950° C., wherein the heating is carried out up to a pre-oxidation temperature window of 550-800° C. in an inert or reducing heating atmosphere, for 1-15 seconds within the pre-oxidation temperature window the heating is carried out in an oxidising pre-oxidation atmosphere in order to cause a pre-oxidation of the surface of the flat steel product, the pre-oxidation atmosphere comprising 0.1-3.0% by volume $O_2$ and optionally 1-50% by volume $H_2$ in addition to $N_2$ and technically unavoidable impurities and having a dew point of −20° C. to +25° C., and after leaving the pre-oxidation window under an inert or reducing atmosphere until the holding temperature is reached;

c) holding the pre-oxidised flat steel product at the holding temperature for 10-120 seconds under a reducing holding atmosphere, the holding atmosphere comprising 1.0-50.0% by volume $H_2$ in addition to $N_2$ and technically unavoidable impurities and having a dew point of −30° C. to +25° C.;

d) optionally: ageing the flat steel product for 1-30 seconds under an inert or reducing ageing atmosphere at an ageing temperature of 430-780°, the ageing atmosphere comprising 1.0-50.0% by volume $H_2$ in addition to $N_2$ and technically unavoidable impurities and having a dew point of −30° C. to +25° C.;

e) passing the flat steel product through a nozzle area and then through a molten bath in which the flat steel product is hot dip coated with the metallic coating, wherein the flat steel product is held in the nozzle area under an inert or reducing nozzle atmosphere until it enters the molten bath, the nozzle atmosphere having a dew point of −80° C. to −25° C. and comprising 1-50% by volume $H_2$ in addition to $N_2$ and technically unavoidable impurities or completely consisting of $H_2$ and technically unavoidable impurities, and the temperature of the flat steel product as it passes through the nozzle area is 430-780° C.

2. The method according to claim 1, wherein the work step a) is completed within 1-5 seconds.

3. The method according to claim 1, wherein the heating temperature in the work step a) is 200° C.-500° C.

4. The method according to claim 1, wherein the flat steel, product is subjected to recrystallising annealing before the work step a) and the holding temperature is 750° C.-850° C.

5. The method according to claim 1, wherein the flat steel product enters the work step a) in an as-rolled state and the holding temperature is 800° C.-850° C.

6. The method according to claim 1, wherein the hot dip coating is carried out as hot dip galvanising and the ageing temperature set during the optionally carried out ageing is 430° C.-650° C.

7. The method according to claim 1, wherein the hot dip coating is carried out as hot dip aluminising and the ageing temperature set during the optionally carried out ageing is 650° C.-780° C.

8. The method according to claim 1, wherein the hot dip coating of the flat steel product is carried out as hot dip galvanising and the molten bath temperature is 420° C.-600° C.

9. The method according to claim 1, wherein the hot dip coating of the flat steel product is carried out as hot dip aluminising and the molten bath temperature is 650° C.-780° C.

10. The method according to claim 1, wherein the stainless steel comprises, in addition to iron and unavoidable impurities (in % by weight):

Cr: 5.0-30.0%,
Mn: <6.0%,
Mo: <5.0%,
Ni: <30.0%,
Si: <2.0%,
Cu: <2.0%,
Ti: <1.0%,
Nb: <1.0%,
V: <0.5%,
N: <0.2%,
Al: <0.2%, and
C: <0.1%.

11. The method according to claim 10, wherein the steel (in % by weight) comprises: Cr: 10.0-13.0%, Ni: <3.0%, Mn: <1.0%, Ti: <1.0%, and C: <0.03%.

* * * * *

UNITED STATES PATENT AND TRADEMARK OFFICE

CERTIFICATE OF CORRECTION

PATENT NO. : 9,279,175 B2
APPLICATION NO. : 13/819481
DATED : March 8, 2016
INVENTOR(S) : Marc Blumenau et al.

It is certified that error appears in the above-identified patent and that said Letters Patent is hereby corrected as shown below:

In the Claims

Column 10, Line 32, Claim 1, delete "430-780°," and insert -- 430-780° C., --

Signed and Sealed this
Twenty-sixth Day of July, 2016

Michelle K. Lee

Michelle K. Lee
*Director of the United States Patent and Trademark Office*